US007437094B2

(12) United States Patent
Noh

(10) Patent No.: US 7,437,094 B2
(45) Date of Patent: Oct. 14, 2008

(54) IMAGE FORMING APPARATUS HAVING A GAP REGULATING MECHANISM TO REGULATE A GAP BETWEEN A PHOTOSENSITIVE DRUM AND A DEVELOPING ROLLER

(75) Inventor: Joo-hwan Noh, Yongin-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 90 days.

(21) Appl. No.: 11/475,988

(22) Filed: Jun. 28, 2006

(65) Prior Publication Data

US 2007/0036580 A1 Feb. 15, 2007

(30) Foreign Application Priority Data

Aug. 12, 2005 (KR) ..... 10-2005-0074505

(51) Int. Cl.
*G03G 21/18* (2006.01)

(52) U.S. Cl. ..... 399/111; 399/126

(58) Field of Classification Search ..... 399/111, 399/113, 110, 126, 117
See application file for complete search history.

(56) References Cited

U.S. PATENT DOCUMENTS 5,153,640 A * 10/1992 Okabe ..... 399/113
6,385,417 B1 5/2002 Tanaka et al. ..... 399/164
6,397,026 B1 * 5/2002 Buxton et al. ..... 399/111
7,184,686 B2 * 2/2007 Kanno et al. ..... 399/111
7,221,888 B2 * 5/2007 Hymas et al. ..... 399/111
2007/0053717 A1 * 3/2007 Kweon ..... 399/111
2007/0053718 A1 * 3/2007 Choi ..... 399/159

FOREIGN PATENT DOCUMENTS

JP 07-160175 A * 6/1995
JP 9-204101 8/1997
KR 89-14130 8/1989
KR 2004-43580 5/2004

* cited by examiner

*Primary Examiner*—Sophia S Chen
(74) *Attorney, Agent, or Firm*—Stein, McEwen & Bui, LLP

(57) ABSTRACT

An image forming apparatus includes: a main frame; a developing unit, the developing unit including a photosensitive drum to form an electrostatic latent image on an outer surface thereof, a developing roller installed at one side of the photosensitive drum to develop the formed electrostatic latent image, and a developer plate having a drum shaft support groove to support both ends of a photosensitive drum shaft supporting the photosensitive drum and a roller shaft support groove to support both ends of a developing roller shaft supporting the developing roller; and a gap regulating mechanism to vary a gap between the photosensitive drum and developing roller in response to attachment/detachment of the developing unit to/from the main frame. Such image forming apparatus can promote preventing a migration phenomenon that low molecular weight elements leak out from particles constituting the developing roller or photosensitive drum, or that the rollers are squeezed.

31 Claims, 9 Drawing Sheets

IMAGE FORMING APPARATUS HAVING A GAP REGULATING MECHANISM TO REGULATE A GAP BETWEEN A PHOTOSENSITIVE DRUM AND A DEVELOPING ROLLER

CROSS-REFERENCE TO RELATED APPLICATIONS

This application claims benefit under 35 U.S.C. §119(a) of Korean Patent Application No. 2005-74505, filed Aug. 12, 2005 in the Korean Intellectual Property Office, the entire contents of which are incorporated herein by reference.

BACKGROUND OF THE INVENTION

1. Field of the Invention

Aspects of the invention relate to an image forming apparatus. More particularly, aspects of the invention relate to an image forming apparatus which permits adjustment of a gap between a photosensitive drum and a developing roller.

2. Description of the Related Art

Generally, an electro-photographic image forming apparatus, such as a laser beam printer, produces a desired image by forming an electrostatic latent image on a photosensitive medium such as a photosensitive drum or photosensitive belt, developing the formed electrostatic latent image using developing materials having predetermined colors, and transferring the developed image to a recording medium. A developing unit of the image forming apparatus includes components, such as a photosensitive drum, a developing roller, a supplying roller and an agitating roller, and is adapted to be handled as a unit. These rotating rollers rotate in predetermined speed ratios and directions through a series of gears.

The developing unit of the image forming apparatus is typically commanded to produce a test image for inspection after manufacture, and is packaged and shipped, if the developing unit passes the inspection. However, a developing material at a development nip, where the photosensitive drum and developing roller contacts with each other, can be fused on the surface of the photosensitive drum or the surface of the developing roller as a result of high temperature and pressure. If the developing material is fused on the photosensitive drum, the developing material cannot be replenished to the surface of the photosensitive drum for latent image development, and a white image can be produced on a recording medium.

Alternatively, if the developing material is fused on the developing roller, as the photosensitive drum and developing roller do not rotate at a rate or ratio of 1:1, the fused developing material is usually removed in small amounts. However, between 10 and 100 or several hundred sheets of recording media typically have to be printed until the fused developing material is completely removed.

In addition to the above problem of the fused developing material, after the developing unit is sealed in a packing bag, further sealed in a packing box, and shipped, the temperature of the developing unit can rise depending upon the surrounding environment. Also, low molecular weight elements can leak out from particles constituting the developing roller, a charge roller or the photosensitive drum (what is called a migration phenomenon), or the rollers can be squeezed. These problems can be more serious in a contact development method, where the photosensitive drum and the developing roller form a development nip. Also, a band can be formed at the development nip, which can cause production of a defective image having a corresponding blackened or whitened portion. In this regard, a conventional solution is to adopt an extra member to separate the photosensitive drum from the developing roller during a distribution process of the developing unit.

FIG. 1 is a diagram showing the structure of a developing unit having a conventional gap setting device. Referring to FIG. 1, the gap setting device 5 is inserted between a photosensitive drum 1 and a developing roller 3. The gap setting device 5 can be made of molded goods, metals, paper or sheets. However, a problem can occur in that the user in person must usually remove the gap setting device 5.

An example to maintain the gap between a photosensitive drum and developing roller is disclosed in Japanese Patent Laid-Open Publication No. 1997-204101. According to Japanese Patent Laid-Open Publication No. 1997-204101, in a developing unit, a support plate to support the shaft of the developing roller is placed to be freely slidable relative to the sliding axis thereof, a coil is placed on the support plate, and the coil is driven through a magnetic field created by a magnet and a yoke. Further, to keep constant the gap between the developing roller and the photosensitive drum, the gap is measured through laser emitting and receiving devices, an electric current is supplied to the coil, and the support plate is slid relative to the sliding axis, moving the developing roller in conjunction with the support plate.

Another example to adequately maintain the gap between a photosensitive drum and developing roller is disclosed in U.S. Pat. No. 6,385,417. According to U.S. Pat. No. 6,385,417, in a developing unit, the photosensitive drum is provided to form an electrostatic latent image on the surface thereof, the developing roller is provided to develop the electrostatic latent image using a developing material, and a gap regulating unit is provided to maintain constant the gap between the photosensitive drum and developing roller. The gap regulating unit includes first bearings installed at both ends of a shaft of the photosensitive drum, and second bearings installed at both ends of a shaft of the developing roller.

The disclosed developing units in Japanese Patent Laid-Open Publication No. 1997-204101 and U.S. Pat. No. 6,385,417 are structured to maintain constant the gap between the photosensitive drum and developing roller in non-contact development methods. Thus, various problems in the distribution process of a developing unit of an image forming apparatus are not directly considered in these developing units disclosed in Japanese Patent Laid-Open Publication No. 1997-204101 and U.S. Pat. No. 6,385,417.

SUMMARY OF THE INVENTION

Aspects of the invention promote addressing problems and disadvantages in the distribution process of a developing unit of an image forming apparatus, as described, and promote providing various advantages in this regard. Accordingly, several aspects and example embodiments of the invention provide an image forming apparatus to permit an effective adjustment of a gap between a photosensitive drum and a developing roller of a developing unit of an image forming apparatus.

According to aspects and an example embodiment of the invention, there is provided an image forming apparatus including: a main frame; a developing unit, the developing unit including a photosensitive drum to form an electrostatic latent image on an outer surface of the photosensitive drum, a developing roller installed, or positioned, at one side of the photosensitive drum to develop the formed electrostatic latent image, and a developer plate having a drum shaft support groove to support both ends of a photosensitive drum shaft supporting the photosensitive drum and a roller shaft support groove to support both ends of a developing roller shaft supporting the developing roller; and a gap regulating mechanism to selectively vary a gap between the photosensitive drum and the developing roller in response to attachment or detachment of the developing unit to or from the main frame.

The gap regulating mechanism can include a horizontal transport unit to transport the photosensitive drum shaft or developing roller shaft in a shaft direction, and the gap regulating mechanism can also include a gap setting unit to adjust a gap between an outer periphery of the photosensitive drum shaft or the developing roller shaft, when transport in the shaft direction, and the drum shaft support groove or roller shaft support groove, respectively. The horizontal transport unit is provided in one side surface of the main frame, and can include a cam surface to contact with one end of the photosensitive drum shaft or developing roller shaft and to push the photosensitive drum shaft or developing roller shaft in the shaft direction.

The gap setting unit can include a protruding portion formed to project from an inner surface of the drum shaft support groove or roller shaft support groove, and the gap setting unit can also include a groove portion formed in a periphery surface of the photosensitive drum shaft or the developing roller shaft. The protruding portion can include a circular protruding band around an inner periphery surface of the drum shaft support groove or roller shaft support groove, and the groove portion can include a circular grooved band corresponding to the circular protruding band.

The image forming apparatus can further include a stopper unit to limit horizontal movement of the photosensitive drum shaft or developing roller shaft. The stopper unit can include a stopping threshold formed, or positioned, at an end of the drum shaft support groove or roller shaft support groove, and the stopper unit can also include a stopping protrusion formed at the photosensitive drum shaft or developing roller shaft.

The gap regulating mechanism can be installed, or positioned, to transport the photosensitive drum shaft, and one end of the photosensitive drum shaft to horizontally transport can bee selectively contactable with a ground provided at one side surface of the main frame. The gap regulating mechanism can be configured wherein a distance between the photosensitive drum shaft and developing roller shaft when the developing unit is detached from the main frame is greater than a distance between the photosensitive drum shaft and developing roller shaft when the developing unit is installed in the main frame.

The cam surface can include a protruding surface projected from an inner surface of the main frame, and a tapering surface slanted at a predetermined angle to interface the protruding surface with the inner surface of the main frame. An end of the photosensitive drum shaft or developing roller shaft contacting with the cam surface can have a curved surface.

According to a further embodiment and aspects of the invention, a method of regulating a gap between rollers of a developing unit in an image forming apparatus is provided, the method including: supporting a photosensitive drum of the developing unit in relation to a developing roller of the developing unit to selectively provide a gap between the photosensitive drum and the developing roller; and selectively varying the gap between the photosensitive drum and the developing roller in response to attachment or detachment of the developing unit to or from the image forming apparatus.

Additional aspects and/or advantages of the invention are set forth in the description which follows or are evident from the description, or can be learned by practice of the invention.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE EMBODIMENTS

Figure 1:
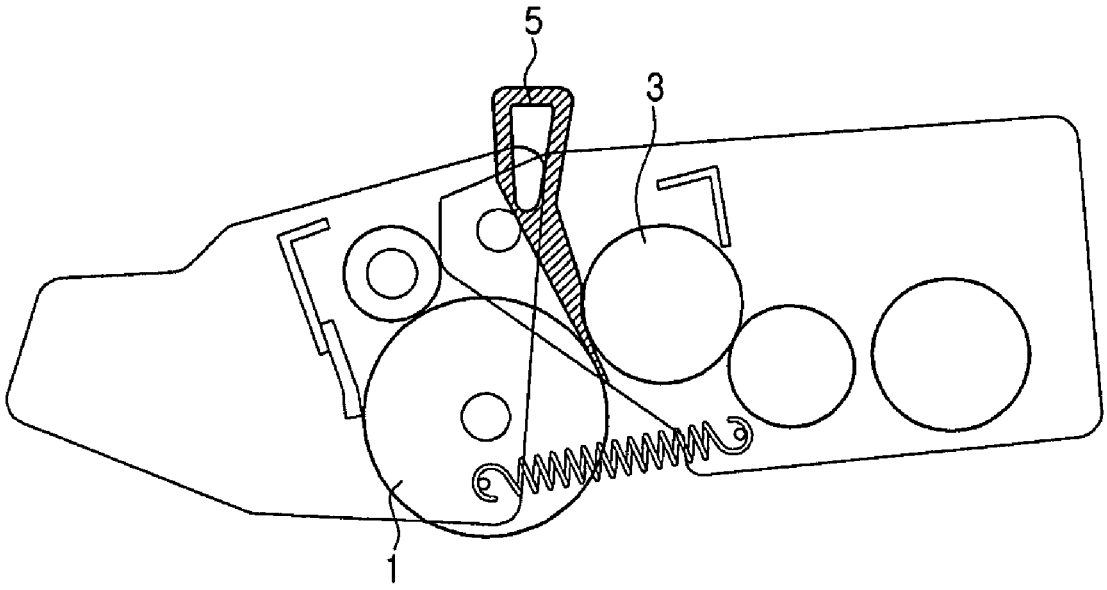
FIG. 1 (PRIOR ART)
FIG. 1 is a diagram showing the structure of a developing unit having a conventional gap setting device.

Reference will now be made in detail to embodiments of the invention, examples of which are illustrated in the accompanying drawings, wherein like reference numerals refer to the like elements throughout. The embodiments are described below in order to explain aspects of the invention by referring to the figures, with well-known functions or constructions not necessarily being described in detail.

Figure 2:
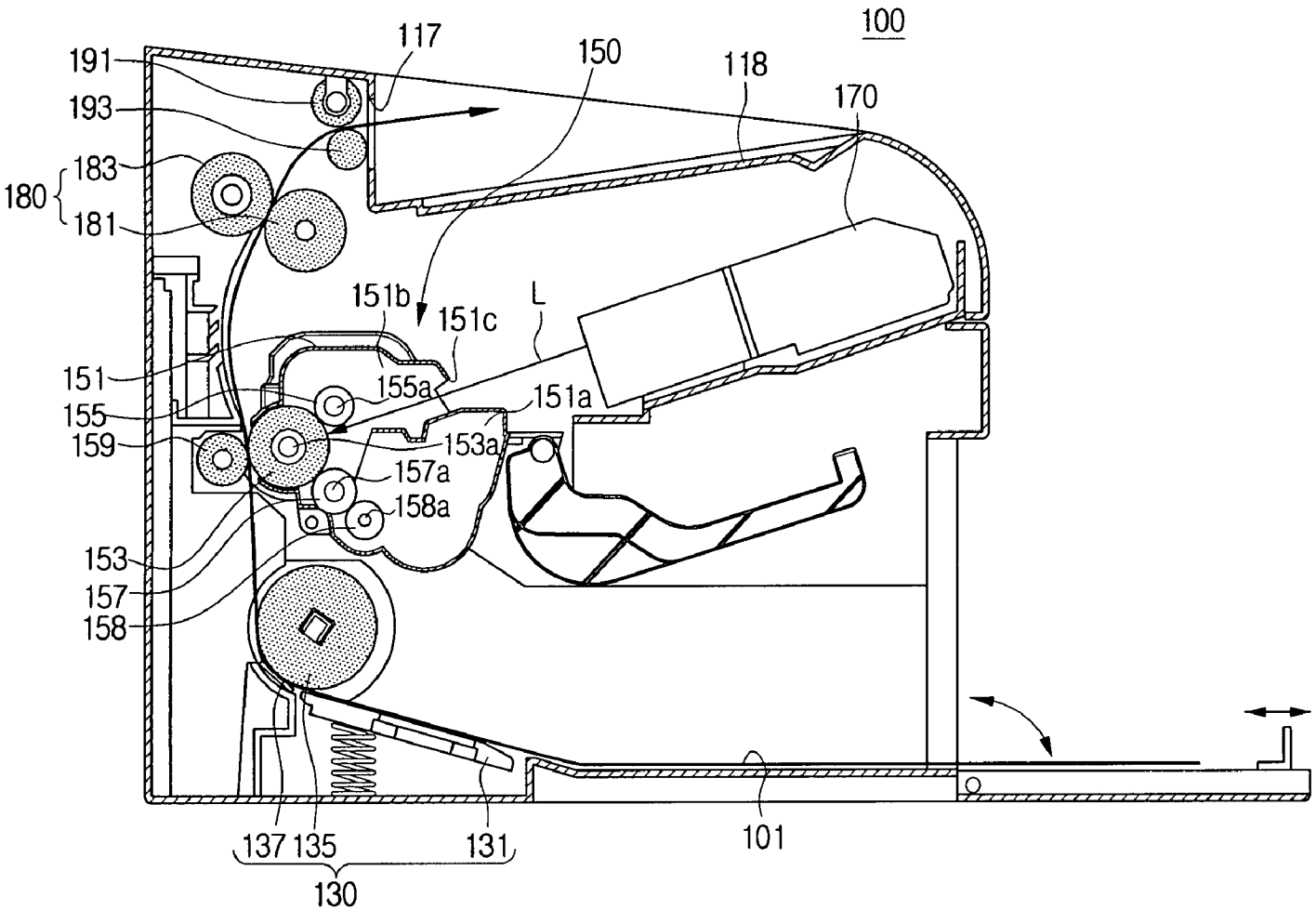
FIG. 2 is a functional diagram illustrating an overall operation of an image forming apparatus according to an embodiment of the invention.

FIG. 2 is a functional diagram illustrating an overall operation of an image forming apparatus 100 according to an embodiment of the invention. Referring to FIG. 2, when a pick-up roller 135 rotates in response to a print command, through a frictional force between the pick-up roller 135 and a friction pad 137, a sheet of recording media 101 is separated from the recording media 101 loaded on the upper surface of a knock-up plate 131 and then fed between a photosensitive drum 153 and transferring roller 159. According to aspects of the invention the image forming apparatus 100 can be an image forming apparatus for various types of suitable media. The recording media 101 can include, for example, paper, film, transparency or other suitable type media for image forming, and the invention is not limited in this regard.

The surface of the photosensitive drum 153 is uniformly charged with electricity by discharge of a charge roller 155. The charged surface of the photosensitive drum 153 is exposed in a desired pattern by a laser beam L which is emitted from a laser scanning unit 170 and which passes through an opening 151*c*, forming an electrostatic latent image. A developing roller 157 adjacent to the surface of the photosensitive drum 153 rotates to form a toner image on a portion of the surface where the electrostatic latent image is formed. The transferring roller 159 rotates and applies pressure to the photosensitive drum 153 to transfer the toner image formed on the photosensitive drum 153 onto the sheet of the recording media 101 fed through a recording medium feeder 130.

The sheet of the recording media 101 is transported further and passed between a heat roller 181 and a press roller 183 of a fixing unit 180, where heat and pressure are applied to the sheet of the recording media 101 to fix the toner image composed of toner powder on the sheet of the recording media 101. The sheet of the recording media 101 having the toner image fixed thereon is transported by an exit roller 191 and exit idle roller 193 through a paper exit 117 to an exit tray 118, on which the sheet of the recording media 101 is loaded, to complete a printing operation by the image forming apparatus 100.

A developing unit 150 of the image forming apparatus 100 includes a cartridge 151, which includes a toner containing section 151*a* for storing a developing material, and a developing section 151*b* for developing an image on a supplied sheet of the recording media 101 using a potion of the developing material transported from the toner containing section 151*a*. The photosensitive drum 153 rotatable at a predetermined speed is installed in the developing section 151*b* such that a part of the photosensitive drum 153 projects into the outside of the cartridge 151. The charge roller 155 is installed, or positioned, at one side of the photosensitive drum 153 to charge the surface of the photosensitive drum 153 with a predetermined voltage. The developing roller 157 is installed, or positioned, at another side of the photosensitive drum 153 to attach a toner on the surface of the photosensitive drum 153 having an electrostatic latent image. A supplying roller 158 is installed, or positioned, at one side of the developing roller 157 in a direction opposite to the photosensitive drum 153 to supply the toner to the developing roller 157.

Figure 3:
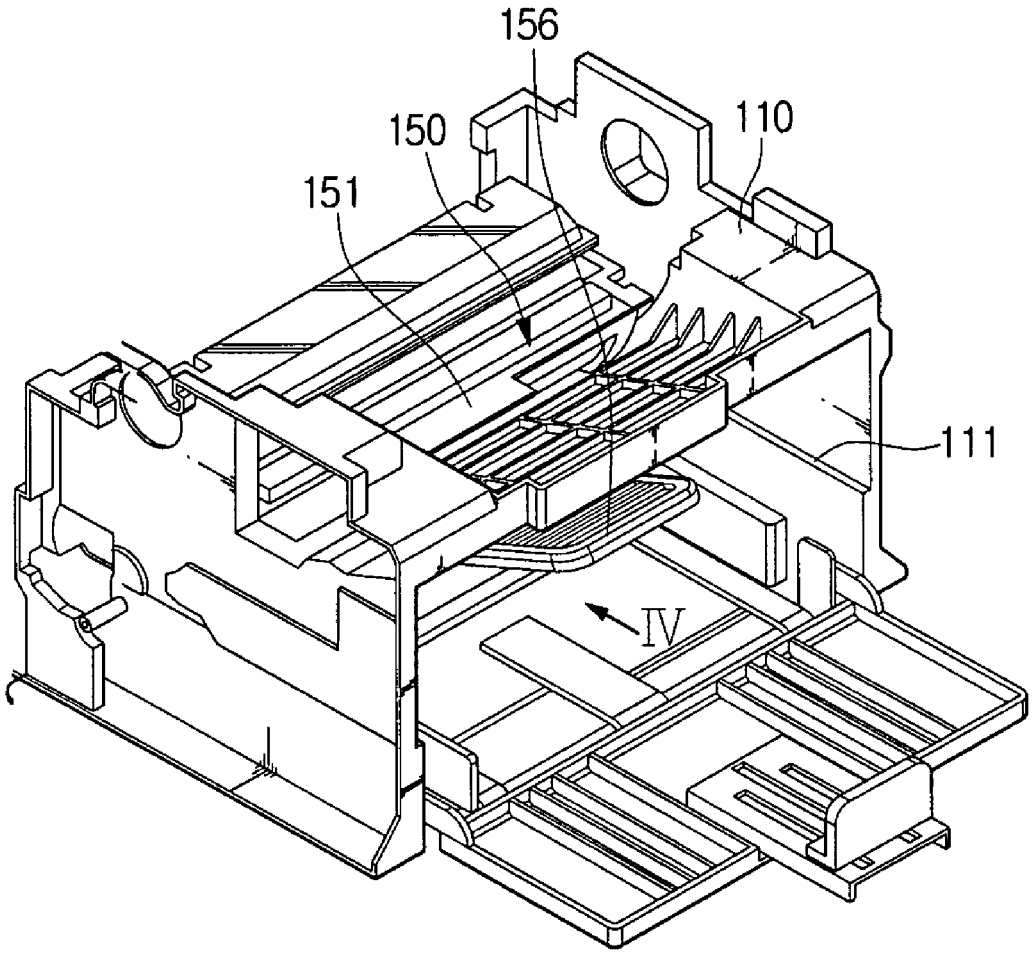
FIG. 3 is a view illustrating attachment/detachment of a developing unit of the image forming apparatus shown in FIG. 2.
Figure 4:
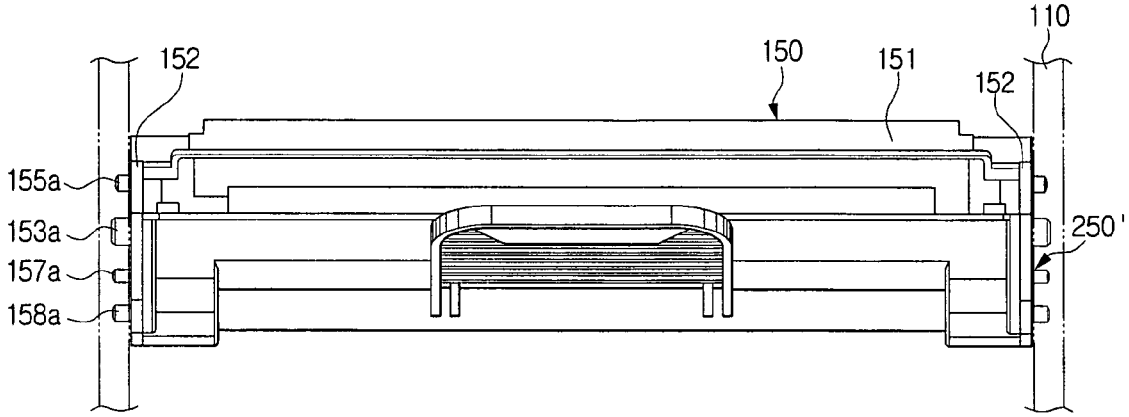
FIG. 4 is a front view of the developing unit of FIG. 3 in the direction of an arrow IV.

FIG. 3 is a view illustrating attachment/detachment of the developing unit 150 of FIG. 2, and FIG. 4 is a front view of the developing unit 150 of FIG. 3 in the direction of an arrow IV in FIG. 3. Referring to FIGS. 3 and 4, the developing unit 150 is an integrated cartridge which is replaced with a new one at the end of the lifetime thereof. When a recording medium jam occurs, the developing unit 150 is detached from a main frame 110 of the image forming apparatus 100 using a handle 156, and then is reinstalled and used after removal of the jam. The main frame 110 includes guide rails 111 formed at two opposing sides of the main frame 110 to guide the attachment/detachment of the developing unit 150. Both ends of rotation shafts 153*a*, 155*a*, 157*a* and 158*a* of the photosensitive drum 153, charge roller 155, developing roller 157 and supplying roller 158, respectively, are supported by a developer plate 152.

Figure 5:
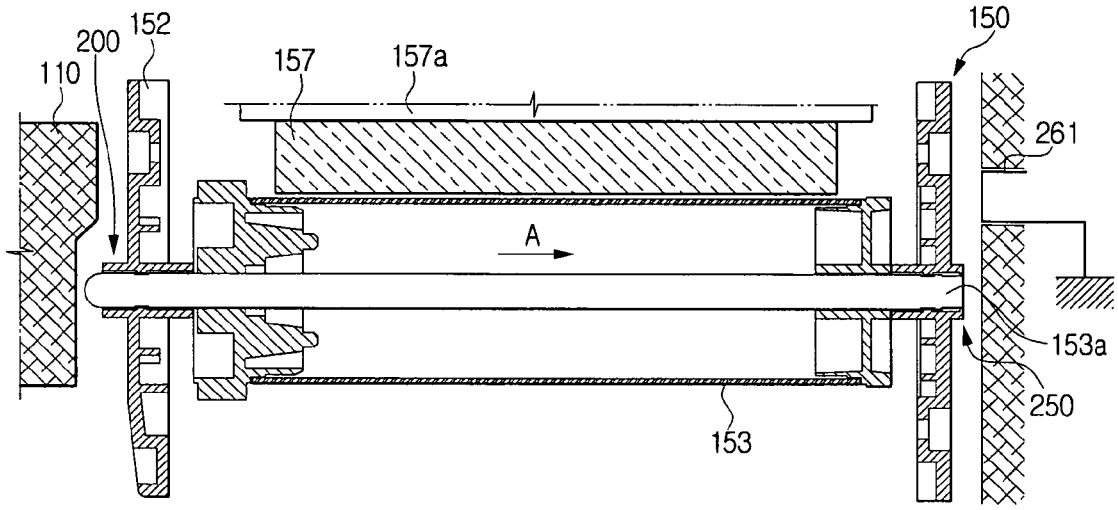
FIG. 5 is a view showing an apparatus to adjust the gap between a photosensitive drum and developing roller according to an embodiment and aspects of the invention.
Figure 6A:
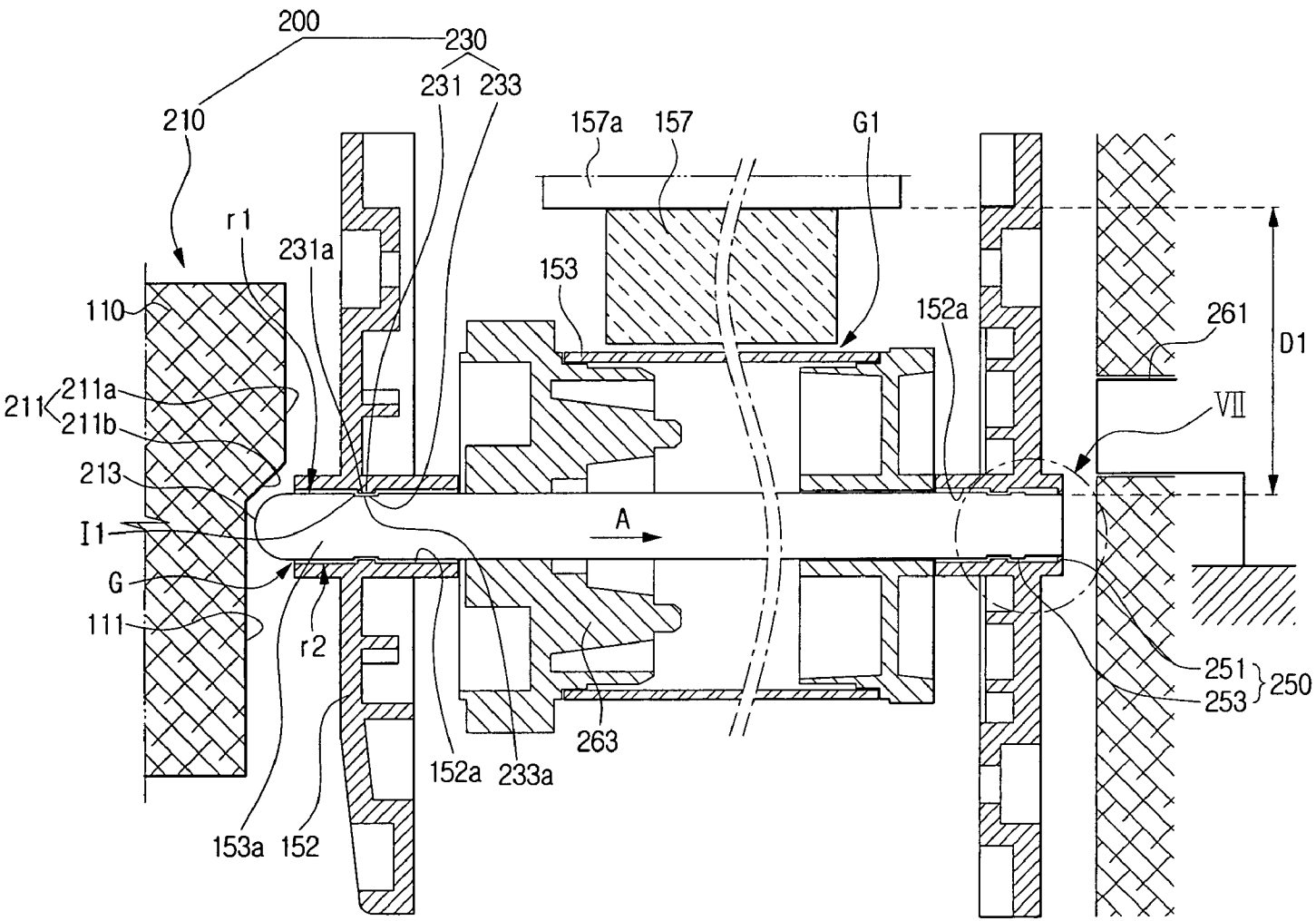
FIG. 6A and FIG. 6B are views showing configurations before and after installation of the developing unit, respectively, according to an embodiment and aspects of the invention.

The variation of the gap between the photosensitive drum 153 and developing roller 157 in response to the attachment or detachment of the developing unit 150 along the guide rails 111 is described with reference to FIGS. 5, 6A and 6B. FIG. 5 is a view to show adjusting the gap between the photosensitive drum 153 and developing roller 157 according to aspects of the invention. FIG. 6A is a view showing a configuration before installation of the developing unit 150 in the image forming apparatus 100 according to an embodiment and aspects of the invention, and FIG. 6B is a view showing the configuration after installation of the developing unit 150 in the image forming apparatus 100, according to aspects of the invention.

Figure 6B:
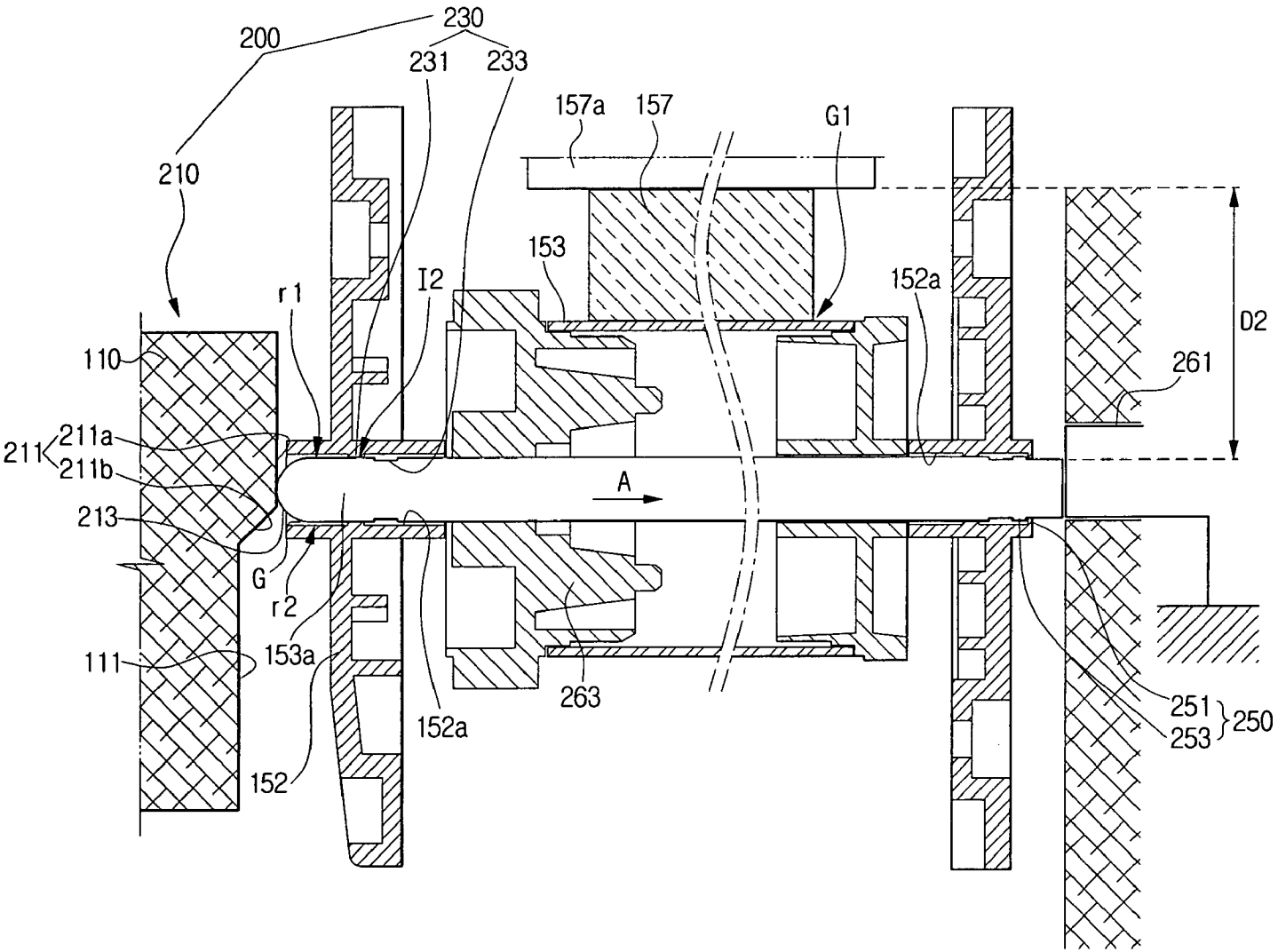

A gap regulating mechanism 200 is shown in FIGS. 5, 6A and 6B to selectively vary the gap between the photosensitive drum 153 and the developing roller 157 in response to the selective attachment or detachment of the developing unit 150. The gap regulating mechanism 200 is configured to selectively adjust a distance between the photosensitive drum shaft 153*a* and the developing roller shaft 157*a*, wherein the distance D1 between the photosensitive drum shaft 153*a* and the developing roller shaft 157*a*, when the developing unit 150 is detached from the main frame 110, such as shown in FIG. 6A before installation of the developing unit 150 in the image forming apparatus 100, is greater than the distance D2 between the photosensitive drum shaft 153*a* and the developing roller shaft 157*a*, when the developing unit 150 is installed in the main frame 110 of the image forming apparatus 100, such as shown in FIG. 6B after installation of the developing unit 150 in the image forming apparatus 100.

The gap regulating mechanism 200 can be installed to engage the photosensitive drum 153 and/or developing roller 157, and the exemplary description is provided where the gap regulating mechanism 200 is installed to engage the photosensitive drum 153, although the invention is not limited in this regard. Referring to FIGS. 6A and 6B, the gap regulating mechanism 200 includes a horizontal transport unit 210 to transport the photosensitive drum shaft 153*a* in the shaft direction A, and a gap setting unit 230 to adjust the gap G between the outer radius r1 of the photosensitive drum shaft 153*a*, when transported in the shaft direction A, and the inner radius r2 of a drum shaft support groove 152*a*.

The horizontal transport unit 210 is provided, or positioned, in one side surface of the main frame 110, and includes a cam surface 211 contacting with an end of the photosensitive drum shaft 153*a* to push the photosensitive drum shaft 153*a*, as for example, in the shaft direction A. The cam surface 211 can include a protruding surface 211*a* projected from the inside of the main frame 110 from the surface of a guide rail 111, and a tapering surface 211*b* slanted at a predetermined angle to interface the protruding surface 211*a* with the surface of the guide rail 111 at the predetermined angle. According to aspects of the invention, the end of the photosensitive drum shaft 153*a* contacting with the cam surface 211 typically has a curved surface 213.

The gap setting unit 230 can include a protruding portion 231 projecting from the inner surface of the drum shaft support groove 152*a*, and a groove portion 233 formed at the periphery surface of the photosensitive drum shaft 153*a*. According to aspects of the invention, the protruding portion 231 can include a circular protruding band 231*a* around the inner periphery of the drum shaft support groove 152*a* and the groove portion 233 can include a circular grooved band 233*a* corresponding to the circular protruding band 231*a*. In addition, according to aspects of the invention, a ground 261 can be provided at the other side of the main frame 110, in an opposing surface of the main frame 110 in facing relation to the protruding surface 211*a* of the cam surface 211, to ground the photosensitive drum 153, such as by selectively contacting the photosensitive drum shaft 153*a*. Cap members 263 provide a gear portion to couple the photosensitive drum shaft 153*a* to the photosensitive drum 153 and transfer a rotational force to the photosensitive drum 153.

Figure 6C:
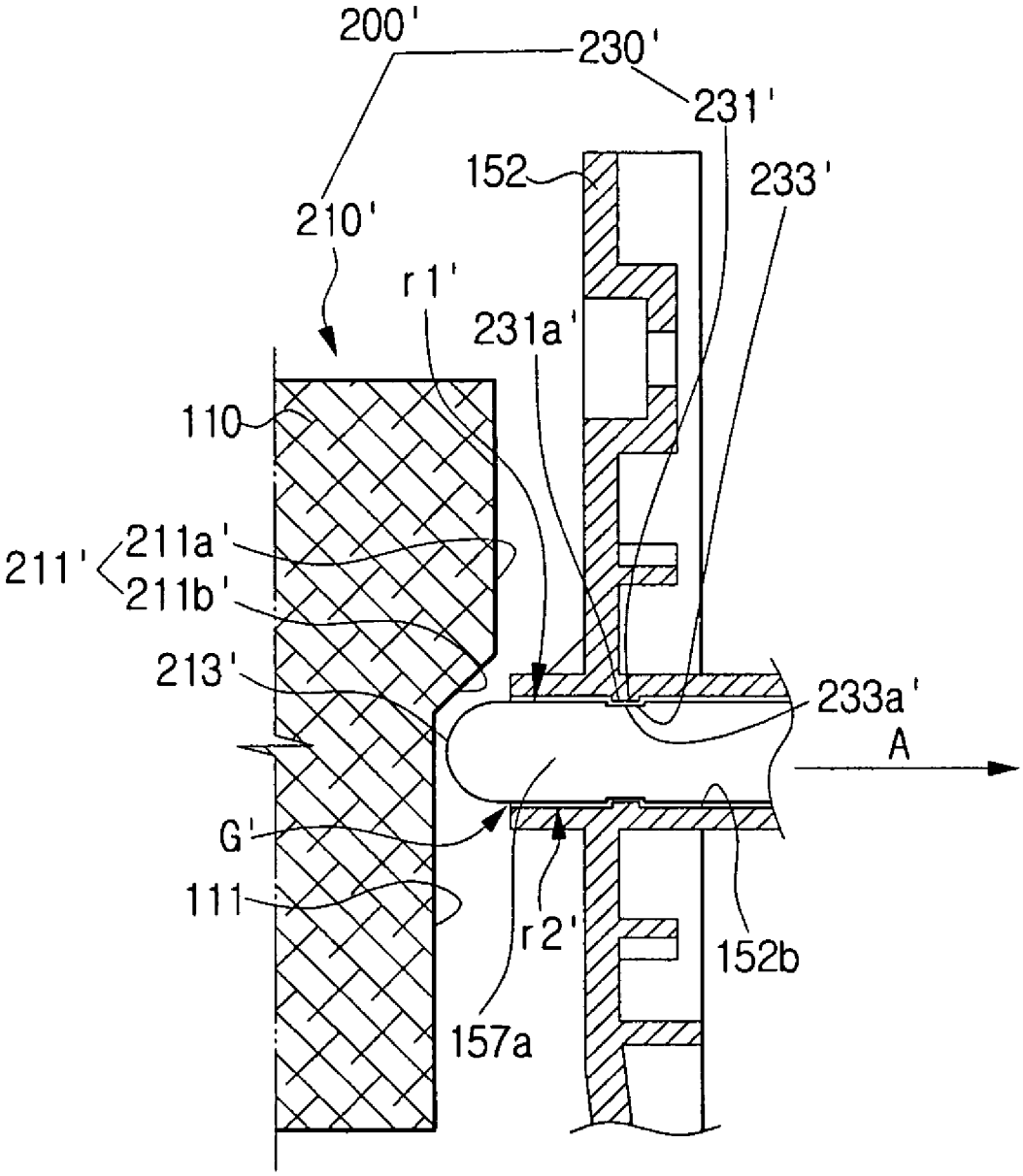
FIG. 6C is a view illustrating a gap regulating mechanism according to an embodiment and aspects of the invention.

Referring to FIG. 6C, the gap regulating mechanism 200' can also be installed to engage the developing roller 157 of the image forming apparatus 100. The exemplary description is also provided where the gap regulating mechanism 200' is installed to engage the developing roller 157, although the invention is not limited in this regard. Referring to FIG. 6C, the gap regulating mechanism 200' includes a horizontal transport unit 210' to transport the developing roller shaft 157*a* in the shaft direction A, and a gap setting unit 230' to adjust the gap G' between the outer radius r1' of the developing roller shaft 157*a*, when transported in the shaft direction A, and the inner radius r2' of a roller shaft support groove 152*b*.

The horizontal transport unit 210' is provided, or positioned, in one side surface of the main frame 110, and includes a cam surface 211' contacting with an end of the developing roller shaft 157*a* to push the developing roller shaft 157*a*, as for example, in the shaft direction A. The cam surface 211' can include a protruding surface 211*a'* projected from the inside of the main frame 110 from the surface of a guide rail 111, and a tapering surface 211*b'* slanted at a predetermined angle to interface the protruding surface 211*a'* with the surface of the guide rail 111 at the predetermined angle. According to aspects of the invention, the end of the developing roller shaft 157*a* contacting with the cam surface 211' typically has a curved surface 213'.

Continuing with reference to FIG. 6C, the gap setting unit 230' can include a protruding portion 231' projecting from the inner surface of the roller shaft support groove 152*b*, and a groove portion 233' formed at the periphery surface of the developing roller shaft 157*a*. According to aspects of the invention, the protruding portion 231' can include a circular protruding band 231*a'* around the inner periphery of the roller shaft support groove 152*b* and the groove portion 233' can include a circular grooved band 233*a'* corresponding to the circular protruding band 231*a'*.

Figure 7B:
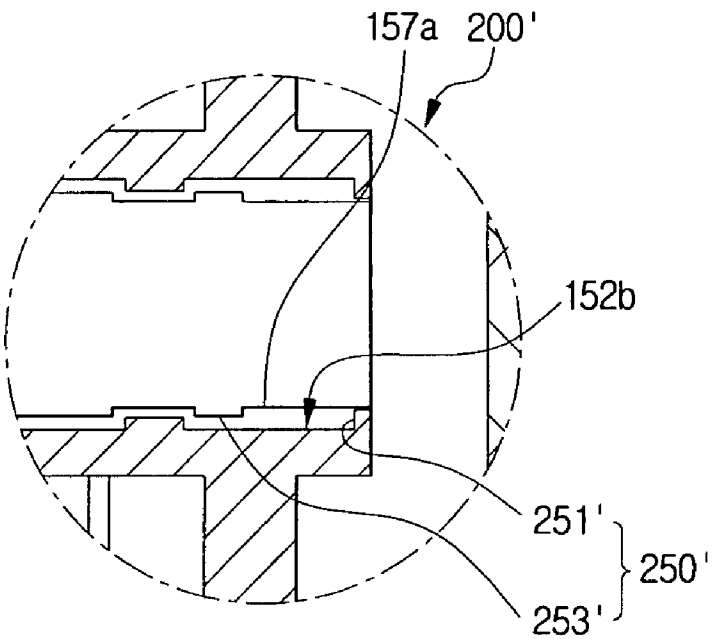
FIG. 7B is an enlarged view of a stopper unit of the gap regulating mechanism of FIG. 6C.
Figure 7A:
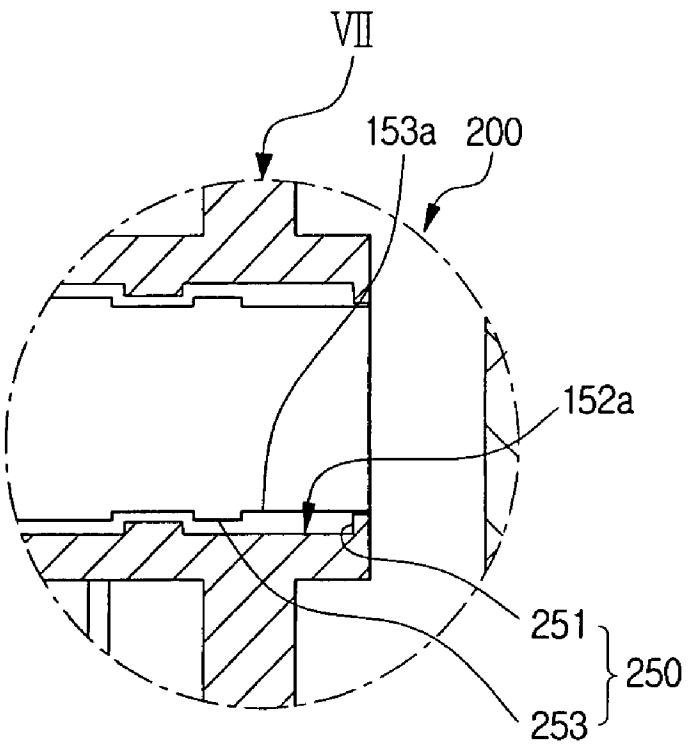
FIG. 7A is an enlarged view showing a portion of FIG. 6A indicated by the Roman character VII.

FIG. 7A is an enlarged view showing a portion of FIG. 6A indicated by the Roman character VII in FIG. 6A. Referring to FIG. 7A, the gap regulating mechanism 200 can further include a stopper unit 250 to limit the movement of the photosensitive drum shaft 153*a* in the shaft direction A. The stopper unit 250 includes a stopping threshold 251 formed at an end of the drum shaft support groove 152*a*, and a stopping protrusion 253 formed at, or on, the photosensitive drum shaft 153*a*. In the illustrated example embodiment of the stopper unit 250, the stopping threshold 251 can be formed as a single body at, or on, the drum shaft support groove 152*a* and the stopping protrusion 253 can be formed as a single body at, or on, the photosensitive drum shaft 153*a*. Also, the stopper unit 250 can employ separately formed members as stopping protrusion 253 and as the stopping threshold 251; and an E-ring can be utilized instead of the stopping threshold 251, for example, with the invention not being limited in this regard.

FIG. 7B is an enlarged view illustrating the gap regulating mechanism 200' of FIG. 6C can further include a stopper unit 250' to limit the movement of the developing roller shaft 157*a* in the shaft direction A (location of stopper unit 250' indicated in FIG. 4). The stopper unit 250' includes a stopping threshold 251' formed at an end of the roller shaft support groove 152*b*, and a stopping protrusion 253' formed at, or on, the developing roller shaft 157*a*. In the illustrated example embodiment of the stopper unit 250', the stopping threshold 251' can be formed as a single body at, or on, the roller shaft support groove 152*b* and the stopping protrusion 253' can be formed as a single body at, or on, the developing roller shaft 157*a*. Also, the stopper unit 250' can employ separately formed members as stopping protrusion 253' and as the stopping threshold 251' and an E-ring can be utilized instead of the stopping threshold 251', for example, with the invention not being limited in this regard.

A description of how the gap G1 between the photosensitive drum 153 and developing roller 157 is selectively varied according to aspects of the invention is further described with reference to FIGS. 6A and 6B. As shown in FIG. 6A, when the developing unit 150 is not installed in the main frame 110, the photosensitive drum shaft 153*a* is placed, or positioned, to project in the direction of the cam surface 211, the protruding portion 231 formed in the inner surface of the drum shaft support groove 152*a* is positioned in corresponding relation to he groove portion 233 formed in the outer surface of the photosensitive drum shaft 153*a*, and the protruding portion 231 is separated from the groove portion 233 at a predetermined interval 11. Thus, the gap G1 between the photosensitive drum 153 and developing roller 157 becomes relatively wide.

As shown in FIG. 6B, when the developing unit 150 is installed in the main frame 110, the photosensitive drum shaft 153*a* is gradually moved in the shaft direction A as the curved surface 213 of the photosensitive drum shaft 153*a* is pushed by the cam surface 211, and the groove portion 233 formed on the photosensitive drum shaft 153*a* is moved out of corresponding relation with the protruding portion 231. At this time, the outer periphery of the photosensitive drum shaft 153*a* gets in contact with the protruding portion 231, narrowing the predetermined interval 11 to an interval 12 located, or measured, from the photosensitive drum shaft 153*a* to the protruding portion 231. Thus, the gap G1 between the photosensitive drum 153 and developing roller 157 becomes relatively narrow and the photosensitive drum 153 and developing roller 157 can contact with each other, as illustrated in FIG. 6B.

The gap G1 between the photosensitive drum 153 and developing roller 157 is typically adjusted in a range of from about 0.05 mm to about 0.2 mm. Thus, the gap adjustment of the gap G1 is not necessarily apparent to the naked eye. Also, in embodiments and according to aspects of the invention, such as described, the gap G1 between the photosensitive drum and the developing roller in an image forming apparatus, such as the photosensitive drum 153 and developing roller 157 in the image forming apparatus 100, is adjusted within a suitable range corresponding to apparatus. Similarly, the described aspects of the invention can also be applied to adjustment of the gap between the photosensitive drum 153 and charge roller 155 in the image forming apparatus 100.

The embodiments and aspects of the invention provide an image forming apparatus where a gap between rollers of a developing unit, for example a photosensitive drum and developing roller, is set during a distribution process of the developing unit, to promote preventing, minimizing or reducing a migration phenomenon wherein low molecular weight elements leak out from particles constituting the developing roller or the photosensitive drum, or to promote preventing, minimizing or reducing another phenomenon wherein the rollers are squeezed. In addition, an advantage, among advantages of the invention is promoted in that, according to aspects of the invention, the rollers, such as the photosensitive drum and the developing roller, can be separated from, or in spaced relation to, one another during the distribution process of the developing unit, and various alternative developing materials, such as toners, can be available in choosing suitable toners for an image forming apparatus.

The foregoing embodiments, aspects and advantages are merely exemplary and are not to be construed as limiting the invention. Also, the description of the embodiments of the invention is intended to be illustrative, and not to limit the scope of the claims, and various other alternatives, modifications, and variations will be apparent to those skilled in the art. Therefore, although a few embodiments of the invention have been shown and described, it would be appreciated by those skilled in the art that changes may be made in the embodiments without departing from the principles and spirit of the invention, the scope of which is defined in the claims and their equivalents.

What is claimed is:

1. An image forming apparatus, comprising:

a main frame;

a developing unit, the developing unit comprising:

a photosensitive body to form an electrostatic latent image on an outer surface thereof, a developing member installed at one side of the photosensitive body to develop the formed electrostatic latent image, and a developer plate including a body shaft support groove to support a photosensitive body shaft supporting the photosensitive body and a member shaft support groove to support a developing member shaft supporting the developing member; and a gap regulating mechanism to decrease a gap between the photosensitive body and the developing member in response to attachment of the developing unit to the main frame, and to increase the gap in response to detachment of the developing unit from the main frame.

2. The image forming apparatus of claim 1, wherein:

the gap regulating mechanism selectively adjusts a gap between the photosensitive body and the developing member, wherein the gap between the photosensitive body and developing member is set during a distribution process of the developing unit, and the photosensitive body is in spaced relation to the developing member during the distribution process of the developing unit.

3. The image forming apparatus of claim 2, wherein:

the gap regulating mechanism selectively adjusts the gap between the photosensitive body and the developing member to minimize a migration phenomenon of low molecular weight elements leaking out from particles comprising the developing member or the photosensitive body.

4. An image forming apparatus, comprising:

a main frame;

a developing unit, the developing unit comprising:

a photosensitive body to form an electrostatic latent image on an outer surface thereof, a developing member installed at one side of the photosensitive body to develop the formed electrostatic latent image, and a developer plate including a body shaft support groove to support a photosensitive body shaft supporting the photosensitive body and a member shaft support groove to support a developing member shaft supporting the developing member; and a gap regulating mechanism to selectively vary a gap between the photosensitive body and the developing member in response to attachment or detachment of the developing unit to or from the main frame, wherein:

the gap regulating mechanism includes a horizontal transport unit to transport the photosensitive body shaft or the developing member shaft in a shaft direction, and a gap setting unit to adjust a gap between an outer periphery of the photosensitive body shaft or the developing member shaft, when transported in the shaft direction, and the body shaft support groove or the member shaft support groove, respectively.

5. The image forming apparatus of claim 4, wherein:

the horizontal transport unit is provided in one side surface of the main frame, and the horizontal transport unit includes a cam surface to contact with one end of the photosensitive body shaft or the developing member shaft to push the photosensitive body shaft or the developing member shaft in the shaft direction.

6. The image forming apparatus of claim 5, wherein:

the cam surface includes a protruding surface projected from an inner surface of the main frame, and a tapering surface slanted at a predetermined angle to interface the protruding surface with the inner surface of the main frame, and wherein an end of the photosensitive body shaft or developing member shaft respectively contacting with the cam surface comprises a curved surface.

7. The image forming apparatus of claim 5, further comprising:

a stopper unit to limit horizontal movement of the photosensitive body shaft or the developing member shaft.

8. The image forming apparatus of claim 7, wherein:

the stopper unit includes a stopping threshold formed at an end of the body shaft support groove or the member shaft support groove, and a stopping protrusion formed at the photosensitive body shaft or the developing member shaft, respectively.

9. The image forming apparatus of claim 5, wherein:

the cam surface includes a protruding surface projected from an inner surface of the main frame, and a tapering surface slanted at a predetermined angle to interface the protruding surface with the inner surface of the main frame.

10. The image forming apparatus of claim 4, wherein:

the gap setting unit includes a protruding portion formed in an inner surface of and projecting respectively from the body shaft support groove or the member shaft support groove, and a groove portion formed in a periphery surface of the photosensitive body shaft or the developing member shaft, respectively.

11. The image forming apparatus of claim 10, wherein:

the protruding portion comprises a circular protruding band around an inner periphery surface of the body shaft support groove or the member shaft support groove, and the groove portion comprises a circular grooved band corresponding to the circular protruding band, respectively.

12. The image forming apparatus of claim 4, further comprising:

a stopper unit to limit horizontal movement of the photosensitive body shaft or the developing member shaft.

13. The image forming apparatus of claim 12, wherein:

the stopper unit includes a stopping threshold formed at an end of the body shaft support groove or the member shaft support groove, and a stopping protrusion formed at the photosensitive body shaft or the developing member shaft, respectively.

14. The image forming apparatus of claim 4, wherein:

the gap regulating mechanism is installed to transport the photosensitive body shaft, and an end of the photosensitive body shaft to be horizontally transported is selectively contactable with a ground.

15. The image forming apparatus of claim 4, wherein:

the gap regulating mechanism selectively adjusts a distance between the photosensitive body shaft and the developing member shaft, wherein a distance between the photosensitive body shaft and the developing member shaft when the developing unit is detached from the main frame is greater than a distance between the photosensitive body shaft and the developing member shaft when the developing unit is installed in the main frame.

16. The image forming apparatus of claim 15, wherein:

the gap regulating mechanism selectively adjusts the gap between the photosensitive body and the developing member in a range of from about 0.05mm to about 0.2 mm.

17. A method of regulating a gap between a member and a body of a developing unit in an image forming apparatus, comprising:

supporting a photosensitive body of the developing unit in relation to a developing member of the developing unit to selectively provide a gap between the photosensitive body and the developing member; and decreasing the gap between the photosensitive body and the developing member in response to attachment of the developing unit to the image forming apparatus, and increasing the gap in response to detachment of the developing unit from the image forming apparatus, in order to minimize a migration phenomenon of low molecular weight elements leaking out from particles comprising the developing member or the photosensitive body.

18. The method of claim 17, further comprising:

selectively adjusting a distance between a photosensitive body shaft supporting the photosensitive body and a developing member shaft supporting the developing member, wherein a distance between the photosensitive body shaft and the developing member shaft when the developing unit is detached from the image forming apparatus is greater than a distance between the photosensitive body shaft and the developing member shaft when the developing unit is installed in the image forming apparatus.

19. The method of claim 17, further comprising:

setting the gap between the photosensitive body and developing member during a distribution process of the developing unit, and positioning the photosensitive body in spaced relation to the developing member during the distribution process of the developing unit.

20. A method of regulating a gap between a member and a body of a developing unit in an image forming apparatus, comprising:

supporting a photosensitive body of the developing unit in relation to a developing member of the developing unit to selectively provide a gap between the photosensitive body and the developing member;

selectively varying the gap between the photosensitive body and the developing member in response to attachment or detachment of the developing unit to or from the image forming apparatus;

transporting a photosensitive body shaft supporting the photosensitive body or a developing member shaft supporting the developing member in a shaft direction to attach the developing unit to the image forming apparatus; and selectively adjusting a gap between an outer periphery of the photosensitive body shaft or the developing member shaft, when transported in the shaft direction, and a body shaft support groove receiving the photosensitive body shaft or a member shaft support groove receiving the developing member shaft, respectively.

21. A method of regulating a gap between a member and a body of a developing unit in an image forming apparatus, comprising:

supporting a photosensitive body of the developing unit in relation to a developing member of the developing unit to selectively provide a gap between the photosensitive body and the developing member; and selectively varying the gap between the photosensitive body and the developing member in response to attachment or detachment of the developing unit to or from the image forming apparatus, wherein the selectively varying the gap comprises:

selectively adjusting the gap between the photosensitive body and the developing member in a range of from about 0.05 mm to about 0.2 mm.

22. A method of regulating a gap between a member and a body of a developing unit in an image forming apparatus, comprising:

supporting a photosensitive body of the developing unit in relation to a developing member of the developing unit; and decreasing a gap between the photosensitive body and the developing member in response to attachment of the developing unit to the image forming apparatus, and increasing the gap in response to detachment of the developing unit to or from the image forming apparatus, in order to minimize a migration phenomenon of low molecular weight elements leaking out from particles comprising the developing member or the photosensitive body.

23. The method of claim 22, further comprising:

setting the gap between the photosensitive body and developing member during a distribution process of the developing unit, and positioning the photosensitive body in spaced relation to the developing member during the distribution process of the developing unit.

24. A developing cartridge of an image forming apparatus, comprising:

a developing cartridge body to support shafts of a photosensitive member and developing member; and a gap regulating unit to decrease a gap between the photosensitive member and the developing member in response to attachment of the developing cartridge body to the image forming apparatus, and to increase the gap in response to detachment of the developing cartridge body to the image forming apparatus, wherein:

the developing cartridge body includes:

a photosensitive member shaft support groove to support the shaft of the photosensitive member, and a developing member shaft support groove to support the shaft of the developing member, and the gap regulating unit includes:

a horizontal transport unit to transport the photosensitive member and developing member in shaft directions, respectively, and a gap regulating unit to adjust a gap between an outer radius of the photosensitive member shaft or developing member shaft and the photosensitive member shaft support groove or the developing member shaft support groove.

25. The developing cartridge of claim 24, wherein the horizontal transport unit includes a cam surface to contact with one end of the photosensitive member shaft of the developing member shaft, to push the photosensitive member shaft in the shaft direction.

26. The developing cartridge of claim 24, wherein the gap regulating unit includes:

a protruding portion formed in an inner surface of and projecting respectively from the photosensitive member shaft support groove or the developing member shaft support groove, and a groove portion formed in a periphery surface of the photosensitive member shaft or the developing member shaft, respectively.

27. The developing cartridge of claim 26, wherein:

the protruding portion comprises a circular protruding band around an inner periphery surface of the photosensitive member shaft support groove or the developing member shaft support groove, and the groove portion comprises a circular grooved band corresponding to the circular protruding band.

28. The developing cartridge of claim 24, wherein:

the cam surface includes:

a protruding surface projected from an inner surface of the image forming apparatus, and a tapering surface slanted at a predetermined angle to interface the protruding surface with the inner surface of the image forming apparatus, and wherein an end of the photosensitive member shaft or developing member shaft respectively contacting with the cam surface comprises a curved surface.

29. A developing cartridge of an image forming apparatus, comprising:

a developing cartridge body to support shafts of a photosensitive member and developing member;

a gap regulating unit to decrease a gap between the photosensitive member and the developing member in response to attachment of the developing cartridge body to the image forming apparatus, and to increase the gap in response to detachment of the developing cartridge body to the image forming apparatus; and a stopper unit to limit horizontal movement of the photosensitive member shaft of the developing member shaft.

30. The developing cartridge of claim 29, wherein the stopper unit includes:

a stopping threshold formed at an end of a photosensitive member shaft support groove or a developing member shaft support groove, and a stopping protrusion formed at the photosensitive member shaft of the developing member shaft.

31. A developing cartridge of an image forming apparatus, comprising:

a developing cartridge body to support shafts of a photosensitive member and developing member; and a gap regulating unit to decrease a gap between the photosensitive member and the developing member in response to attachment of the developing cartridge body to the image forming apparatus, and to increase the gap in response to detachment of the developing cartridge body to the image forming apparatus, wherein:

the gap regulating unit is installed to transport the photosensitive member shaft, and an end of the photosensitive member shaft to be horizontally transported is selectively contactable with a ground.

* * * * *